US009886918B2

(12) United States Patent
Tang

(10) Patent No.: US 9,886,918 B2
(45) Date of Patent: Feb. 6, 2018

(54) METHOD FOR DRIVING LIQUID CRYSTAL DISPLAY PANEL

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventor: Yuejun Tang, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 14/778,296

(22) PCT Filed: Jun. 25, 2015

(86) PCT No.: PCT/CN2015/082304

§ 371 (c)(1),
(2) Date: Dec. 30, 2015

(87) PCT Pub. No.: WO2016/197414

PCT Pub. Date: Dec. 15, 2016

(65) Prior Publication Data

US 2017/0169770 A1 Jun. 15, 2017

(30) Foreign Application Priority Data

Jun. 9, 2015 (CN) ..... 2015 1 0314145

(51) Int. Cl.
*G09G 3/36* (2006.01)

(52) U.S. Cl.
CPC ..... *G09G 3/3607* (2013.01); *G09G 3/3614* (2013.01); *G09G 2300/0443* (2013.01); *G09G 2310/0243* (2013.01); *G09G 2310/08* (2013.01)

(58) Field of Classification Search
CPC ..... G09G 3/3614; G09G 2300/0823; G09G 2310/0254
See application file for complete search history.

(56) References Cited

U.S. PATENT DOCUMENTS

2005/0285837 A1* 12/2005 Akimoto ..... G09G 3/3614 345/96
2011/0057917 A1* 3/2011 Ryu ..... G09G 3/3233 345/211

(Continued)

FOREIGN PATENT DOCUMENTS

CN 101324727 12/2008
CN 102054427 5/2011

(Continued)

OTHER PUBLICATIONS

Office Action dated Jan. 18, 2017 in Chinese Patent Application No. CN201510314145.3.

(Continued)

*Primary Examiner* — Grant Sitta
*Assistant Examiner* — Amen Bogale
(74) *Attorney, Agent, or Firm* — Kim Winston LLP

(57) ABSTRACT

A method for driving a liquid crystal display panel is disclosed. The liquid crystal display panel comprises a plurality of sub pixels, and the method comprises presenting images to be displayed on the liquid crystal display panel frame by frame through regulating a gray-scale of each sub pixel of the liquid crystal display panel, wherein durations of image frames are not all equal to one another so as to reduce a direct current bias voltage of the sub pixel. According to the method, the direct current bias voltage during the isochronous driving process can be effectively reduced, and thus the afterimage of the liquid crystal display panel can be alleviated.

5 Claims, 7 Drawing Sheets

(56) References Cited

U.S. PATENT DOCUMENTS

| | | | | |
|---|---|---|---|---|
| 2012/0287100 | A1* | 11/2012 | Woo | G09G 3/3651<br>345/209 |
| 2015/0070344 | A1* | 3/2015 | Park | G09G 3/3648<br>345/212 |
| 2016/0232833 | A1* | 8/2016 | Wang | G09G 3/2092 |

FOREIGN PATENT DOCUMENTS

| | | |
|---|---|---|
| CN | 102496352 | 6/2012 |
| CN | 104637449 | 5/2015 |
| KR | 101358388 | 2/2014 |

OTHER PUBLICATIONS

International Search Report dated Mar. 11, 2016 in International Patent Application No. PCT/CN2015/082304.
Written Opinion dated Mar. 11, 2016 in International Patent Application No. PCT/CN2015/082304.

* cited by examiner

METHOD FOR DRIVING LIQUID CRYSTAL DISPLAY PANEL

CROSS REFERENCE TO RELATED APPLICATION

The present application claims benefit of Chinese patent application CN 201510314145.3, entitled "Method for Driving Liquid Crystal Display Panel" and filed on Jun. 9, 2015, the entirety of which is incorporated herein by reference.

FIELD OF THE INVENTION

The present disclosure relates to the technical field of liquid crystal display, and particularly to a method for driving a liquid crystal display panel.

BACKGROUND OF THE INVENTION

Compared with the Cathode-Ray Tube (CRT) display devices that are widely used in early stage, the Liquid Crystal Displays (LCDs) have the advantages of a light and thin structure, low driving voltage, and low power consumption. Therefore, the LCD devices, especially the active array LCDs are widely used in various electronic apparatuses. In the active array LCD, Thin Film Transistors (TFTs) are arranged to serve as the switching elements for the sub pixels, and enable that the display performance of the LCD can match the CRT display devices with high driving performance.

FIG. 1 schematically shows a structure of an LCD in the prior art.

As shown in FIG. 1, an LCD 100 comprises a first substrate 101, a second substrate 103, and a liquid crystal layer 102 that is arranged between the first substrate 101 and the second substrate 103. The liquid crystal layer 102 comprises liquid crystal molecules 104. The second substrate 103 is provided with a plurality of data lines and a plurality of scanning lines, wherein the data lines as well as the scanning lines cross over with each other so as to form pixel areas. However, in actual situations, in addition to the liquid crystal molecules 104, the liquid crystal layer 102 may further comprise impurity molecules 105, which can have a positive polarity or a negative polarity.

FIG. 2 schematically shows a driving principle of a liquid crystal display panel in the prior art. As shown in FIG. 2, when a gate voltage (i.e., a voltage of a corresponding scanning line) of a TFT changes so that a source and a drain of the TFT are electrically connected with each other, a data line would transmit a data signal to a pixel electrode, and the voltage of the pixel electrode would change (for example, change from a low-level voltage to a high-level voltage). At the same time, the voltage change of the gate of the TFT would generate a feed through voltage on the pixel electrode. In order to balance the data signals at the two ends of the common voltage $V_{com}$, according to the method in the prior art, the common voltage is generally reduced with a certain amount accordingly (i.e., the common voltage $V_{com}$ is changed from a dotted line to a solid line as shown in FIG. 2) so as to avoid an excessive direct current bias voltage.

However, there would still be a certain direct current bias voltage in different liquid crystal display panels and different areas of the same liquid crystal display panel after long time driving because of the differences of the manufacturing process, signal transmission loss, human-caused error, and other factors. In this case, when the liquid crystal display panel is activated for a long time, the impurity molecules in the liquid crystal display panel would move under the action of the direct current bias voltage, and thus an afterimage would be generated.

The afterimage level has become an important indicator for measuring the quality of the liquid crystal display panel. In order to improve the quality of the liquid crystal display panel, on the basis of the regulation of the common voltage $V_{com}$, there are many methods in the prior art for alleviating the afterimage of the liquid crystal display panel, including optimizing the manufacturing environment and condition, optimizing material selection, and optimizing the gamma voltage.

Optimizing the manufacturing environment and condition means removing impurities away from the liquid crystal display panel or preventing the external impurities from entering into the panel during the manufacturing process mainly through guaranteeing a dust-free environment during manufacturing, shortening manufacturing time, cleaning the substrate before One Drop Filling (ODF) and drying quickly after cleaning so as to alleviate the afterimage of the display panel.

Optimizing material selection means reducing the impurities of the liquid crystal display panel through selecting suitable polyimide (PI) material and Liquid Crystal (LC) material, selecting sealing material with low pollution, selecting LC material with good stability and with a low content of polar particles, and so on.

Optimizing the gamma voltage means determining the optimized IS monochrome voltage through regulating the gamma voltage, reducing the differences between common voltages $V_{com}$ at different positions of the liquid crystal display panel, and reducing the differences between common voltages $V_{com}$ of different gray-scales, so as to reduce the maximum direct current bias voltage between the pixel electrodes and the common electrodes of the liquid crystal display panel after long time activation to the largest extent and alleviate the afterimage of the liquid crystal display panel.

However, according to the methods in the prior art, the afterimage of the liquid crystal display panel can only be alleviated to a rather limited extent, and the display effect thereof cannot be improved effectively.

SUMMARY OF THE INVENTION

The present disclosure aims to solve the technical problem of afterimage of the liquid crystal display panel when the panel is driven according to the method in the prior art. In order to solve the aforesaid technical problem, an embodiment of the present disclosure first provides a method for driving a liquid crystal display panel, the liquid crystal display panel comprising a plurality of sub pixels, the method comprising: presenting, in a non-isochronous driving step, images to be displayed on the liquid crystal display panel frame by frame through regulating a gray-scale of each sub pixel of the liquid crystal display panel, wherein durations of image frames are not all equal to one another so as to reduce a direct current bias voltage of the sub pixel and thus alleviate an afterimage of the liquid crystal display panel.

According to an embodiment of the present disclosure, the method further comprises regulating, during a first display period, a duration percentage of a positive image frame and a duration percentage of a negative image frame according to a polarity of the direct current bias voltage of the sub pixel during an isochronous driving procedure, wherein when the direct current bias voltage has a positive polarity, a duration percentage of the negative image frame is regulated to be larger than a duration percentage of the positive image frame during the first display period so as to reduce a positive direct current bias voltage; and wherein when the direct current bias voltage has a negative polarity, the duration percentage of the positive image frame is regulated to be larger than the duration percentage of the negative image frame during the first display period so as to reduce a negative direct current bias voltage.

According to an embodiment of the present disclosure, the first display period comprises a first image frame and a second image frame, and a duration of the first image frame is unequal to that of the second image frame.

According to an embodiment of the present disclosure, the method further comprises applying, during the first image frame, different voltages to a pixel electrode and a common electrode of a first sub pixel respectively, so as to form a first voltage difference between the pixel electrode and the common electrode of the sub pixel; and applying, during the second image frame, different voltages to the pixel electrode and the common electrode of the first sub pixel respectively, so as to form a second voltage difference between the pixel electrode and the common electrode of the sub pixel, wherein a polarity of the first voltage difference is opposite to that of the second voltage difference, and/or an amplitude of the first voltage difference is equal to that of the second voltage difference.

According to an embodiment of the present disclosure, the first display period further comprises a third image frame and a fourth image frame, and a duration of the third image frame is equal to that of the fourth image frame.

According to an embodiment of the present disclosure, the first display period further comprises a third image frame and a fourth image frame, and a duration of the third image frame is unequal to that of the fourth image frame.

According to an embodiment of the present disclosure, when a duration of the positive image frame is longer in the first image frame and the second image frame, a duration of the negative image frame is regulated to be longer in the third image frame and the fourth image frame; and when a duration of the negative image frame is longer in the first image frame and the second image frame, a duration of the positive image frame is regulated to be longer in the third image frame and the fourth image frame.

According to an embodiment of the present disclosure, a signal of the sub pixel of the liquid crystal display panel changes cyclically taking the first display period as a cycle.

According to an embodiment of the present disclosure, with respect to a first sub pixel and a second sub pixel that are arranged on adjacent data lines respectively, a polarity of a voltage difference of a pixel electrode and a common electrode of the first sub pixel is opposite to that of the second sub pixel during a same image frame.

According to the method for driving the liquid crystal display panel in the prior art, the afterimage would be generated in the liquid crystal display panel during display. In the driving method according to the present disclosure, the durations of the image frames are regulated so that they are not all equal to one another. Therefore, the driving method of the liquid crystal display panel is changed from the isochronous driving method (i.e., the durations of image frames are all equal to one another) in the prior art to the non-isochronous driving method (i.e., the durations of image frames are not all equal to one another). In the method according to the present disclosure, the direct current bias voltage generated during the operation of the liquid crystal display panel can be reduced effectively or even eliminated through increasing the ratio of the image frames having a polarity opposite to the polarity of the direct current bias voltage, so that the afterimage of the liquid crystal display panel can be alleviated.

In addition, according to different embodiments of the present disclosure, the direct current bias voltage in the sub pixels can be reduced or eliminated through regulating the durations of the image frames, and the afterimage can be alleviated through regulating the durations of the image frames with the cooperation of the two sub pixels of adjacent data lines.

Moreover, according to an embodiment of the present disclosure, the method further comprises determining whether a time period during which a same image is displayed on the liquid crystal display panel reaches a preset time period, if yes, executing the non-isochronous driving step; and if no, executing an isochronous driving step so as to drive the liquid crystal display panel in an isochronous driving method.

The time period during which the same image is displayed on the liquid crystal display panel does not reach the preset time period means that at this time, dynamic images are displayed on the liquid crystal display panel or a still image is displayed on the liquid crystal display panel for a relatively short time. Under such circumstances, the probability that the afterimage occurs on the liquid crystal display panel is small, and thus the liquid crystal display panel can be driven in the isochronous driving method in order to simplify the driving procedure thereof. In this case, the durations of the image frames do not need to be regulated, so that the data processing amount thereof can be reduced and the driving and display efficiency can be improved.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The drawings necessary for explaining the embodiments or the prior art are introduced briefly below to illustrate the technical solutions of the embodiments of the present disclosure or the prior art more clearly.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments may be combined together in any manner, and the technical solutions obtained in this manner all fall within the scope of the present disclosure.

Many specific details are illustrated hereinafter for providing a thorough understanding of the embodiments of the present disclosure. However, it is obvious for those skilled in the art that, the present disclosure can be implemented in other methods in addition to the details or specifics described herein.

In addition, the steps as shown in the flow chart can be executed in a computer system by a group of computer executable instructions. Although a certain logical sequence is shown in the flow chart, the steps shown or described herein can be executed in other sequences different from the one shown herein in some cases.

Figure 1:
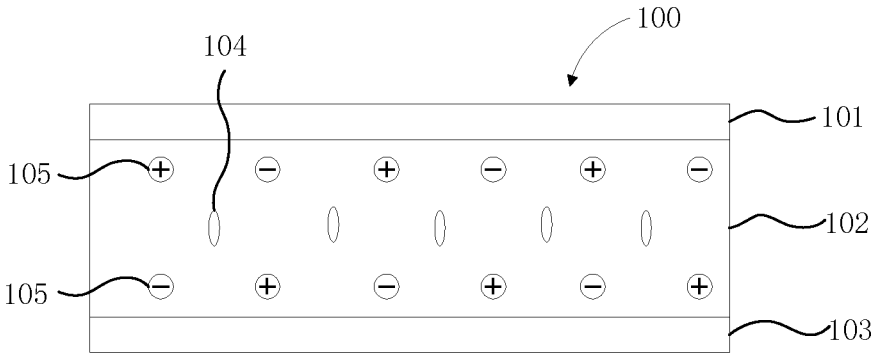
FIG. 1 schematically shows a structure of a liquid crystal display panel in the prior art.
Figure 2:
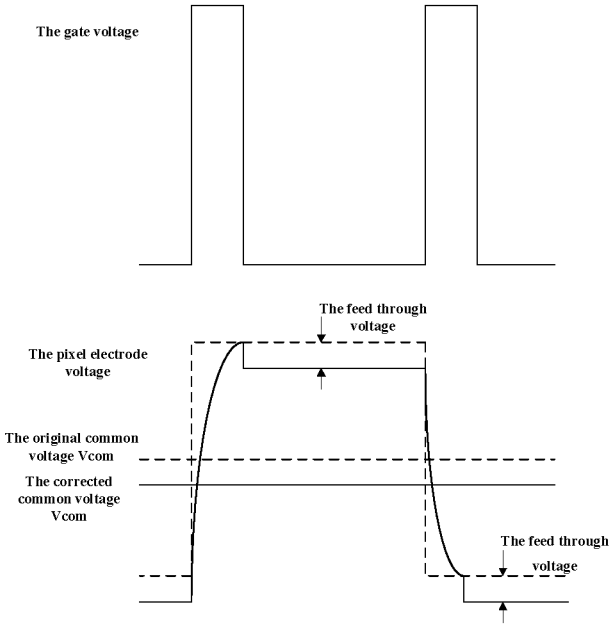
FIG. 2 schematically shows a driving principle of the liquid crystal display panel in the prior art.
Figure 3:
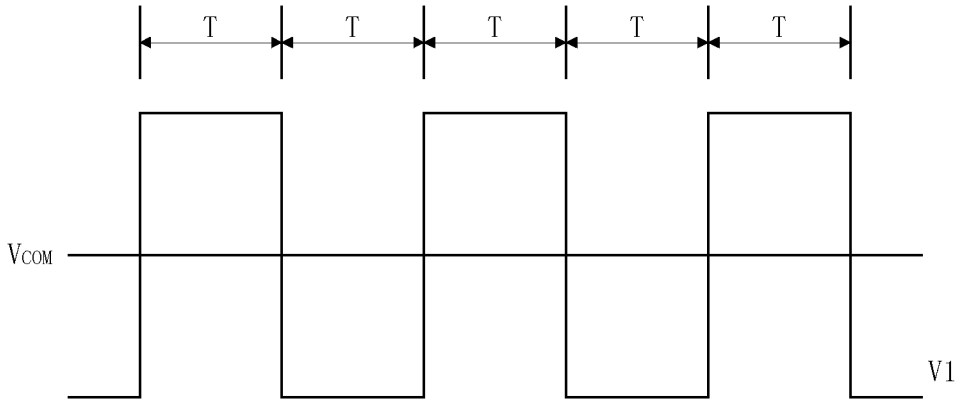
FIG. 3 schematically shows a waveform of a voltage difference between a pixel electrode and a common electrode of a first sub pixel according to a driving method in the prior art.

FIG. 3 schematically shows a waveform of a voltage difference between a pixel electrode and a common electrode of a sub pixel under different image frames according to a method for driving a liquid crystal display panel in the prior art.

It can be seen from FIG. 3 that, in the method for driving the liquid crystal display panel in the prior art, the frames each have a same duration T. That is, with respect to each sub pixel, a duration of a high-level signal of a signal V1 of the pixel electrode is equal to that of a low-level signal thereof, and a time period during which the voltage difference between the pixel electrode and the common electrode has a positive polarity is equal to a time period during which the voltage difference between the pixel electrode and the common electrode has a negative polarity. Therefore, it can be seen that, the liquid crystal display panel in the prior art is driven with an isochronous driving method.

A common voltage $V_{com}$ of the sub pixel needs to be regulated due to the existence of the feed through voltage. However, the driving voltage of the sub pixel would still contain a direct current bias component after the common voltage $V_{com}$ is regulated.

With respect to one sub pixel, the direct current bias voltage can be a positive direct current bias voltage or a negative direct current bias voltage. The impurity particles of the liquid crystal display panel would move under the action of the direct current bias voltage, and a direct current residual voltage would be generated by the impurity particles during the charging and discharging of the liquid crystal display panel. The liquid crystal molecules would not be driven by the signal voltage when the direct current residual voltage is large enough, and thus an afterimage would be generated on the liquid crystal display panel.

The present disclosure provides a novel method for driving the liquid crystal display panel so as to eliminate the aforesaid defect of the method for driving the liquid crystal display panel in the prior art. According to the method, the driving mode with a symmetrical time period of the positive polarity and the negative polarity of the voltage difference between the pixel electrode and the common electrode in the prior art is changed into a driving mode with an asymmetrical time period thereof so as to neutralize the direct current bias voltage of the liquid crystal display panel, and thus alleviate or even eliminate the afterimage of the liquid crystal display panel.

Specifically, according to the method for driving the liquid crystal display panel provided by the present disclosure, the images to be displayed are presented on the liquid crystal display panel frame by frame through regulating a gray-scale of each sub pixel of the liquid crystal display panel, wherein the durations of image frames are not all equal to one another so as to reduce or even eliminate the direct current bias voltage of each sub pixel, and thus alleviate the afterimage of the liquid crystal display panel.

According to the present embodiment, during a first display period, a duration percentage of a positive image frame and a duration percentage of a negative image frame are regulated according to a polarity of the direct current bias voltage of the sub pixel during the isochronous driving procedure. With respect to a certain image frame, if a voltage of the pixel electrode of the sub pixel is larger than a voltage of the common electrode of the sub pixel, the image frame can be referred to as a positive image frame; and if the voltage of the pixel electrode of the sub pixel is smaller than the voltage of the common electrode of the sub pixel, the image frame can be referred to as a negative image frame.

If a positive direct current bias voltage exists in the sub pixel, according to the present method, the durations of the image frames are regulated so that the duration percentage of the negative image frame is larger than the duration percentage of the positive image frame during the first display period, and thus the positive direct current bias voltage existed in the sub pixel can be reduced or even eliminated; and if a negative direct current bias voltage exists in the sub pixel, according to the present method, the durations of the image frames are regulated so that the duration percentage of the positive image frame is larger than the duration percentage of the negative image frame during the first display period, and thus the negative direct current bias voltage existed in the sub pixel can be reduced or even eliminated.

Figure 4:
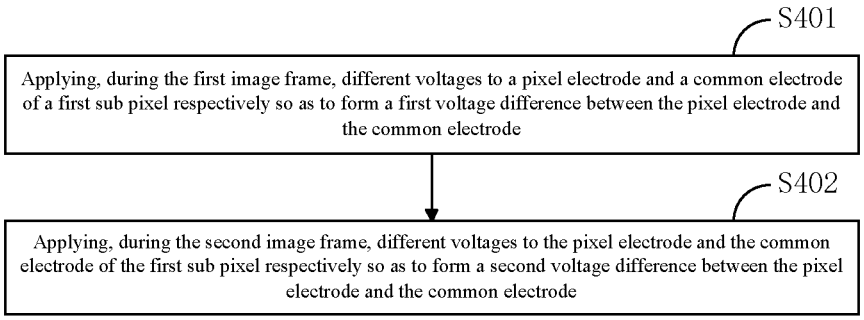
FIG. 4 is a flow chart of a method for driving a liquid crystal display panel according to an embodiment of the present disclosure.

FIG. 4 is a flow chart of the method for driving the liquid crystal display panel according to the present embodiment. With respect to the liquid crystal display panel, the driving method and principle of one sub pixel can be the same as those of other sub pixels. Therefore, in order to facilitate the description, the purposes, principles, and advantages of the present disclosure will be illustrated hereinafter taking the driving procedure of one sub pixel as an example.

As shown in FIG. 4, in step S401, during a first image frame, different voltages are applied to a pixel electrode and a common electrode of a first sub pixel, so as to form a first voltage difference between the pixel electrode and the common electrode.

The procedure that the image is presented on the liquid crystal display panel is essentially the procedure that the gray-scale of each sub pixel is determined, while the gray-scale of each sub pixel is determined through regulating a rotation angle of the liquid crystal corresponding to the sub pixel. With respect to the liquid crystal molecules, the rotation angle is determined by the amplitude of the voltage difference between the pixel electrode and the common electrode. Therefore, the rotation angle of the liquid crystal corresponding to the sub pixel can be regulated through applying different voltages to the pixel electrode and the common electrode of the first sub pixel, and thus the gray-scale of the sub pixel can be regulated.

In step S401, applying the voltage to the pixel electrode is realized through transmitting a data signal and a scanning signal to a corresponding data line and a corresponding scanning line respectively. For example, if the pixel electrode of the first sub pixel needs to be applied with a voltage, the data line corresponding to the sub pixel should be applied with a corresponding voltage when the TFT corresponding to the sub pixel is turned on. In this manner, the pixel electrode is applied with the corresponding voltage.

When the voltage difference exists between the pixel electrode and the common electrode of the sub pixel, an equivalent capacitor between the pixel electrode and the common electrode would be charged. The voltage difference between the pixel electrode and the common electrode can be maintained unchanged or changed slightly during the current image frame due to the existence of the equivalent capacitor.

In step S402, during a second image frame, different voltages are applied to the pixel electrode and the common electrode of the first sub pixel, so as to form a second voltage difference between the pixel electrode and the common electrode.

The liquid crystal molecules cannot be applied with a constant voltage for a long time due to the properties of the liquid crystal molecules; otherwise, the polarity of the liquid crystal molecules would be destroyed and the liquid crystal molecules cannot rotate with the changing of the electric field. In order to avoid the aforesaid situation, the liquid crystal display panel should be driven in an alternating current driving method.

Based on the aforesaid principle, according to the present embodiment, if the first image frame and the second image frame are two adjacent image frames, the polarity of the voltage difference between the pixel electrode and the common electrode of the first sub pixel in the first image frame should be opposite to that in the second image frame, i.e., the polarity of the first voltage difference is opposite to that of the second voltage difference. Specifically, when the first voltage difference is positive, the second voltage difference should be negative; and when the first voltage difference is negative, the second voltage difference should be positive.

In order to reduce or even eliminate the direct current bias voltage during the operation of the sub pixel, according to the method for driving the liquid crystal display panel provided by the present disclosure, the liquid crystal display panel is driven in a non-isochronous driving method rather than the isochronous driving method used in the prior art, whereby the voltage difference between the pixel electrode and the common electrode of the sub pixel can be changed.

According to the method provided by the present disclosure, the durations of the image frames are changed so that the duration of the first image frame is unequal to that of the second image frame. That is, the duration needed by the scanning of the scanning lines in the first image frame is unequal to that in the second image frame. Specifically, the duration of the image frame with the polarity opposite to the polarity of the direct current bias voltage during the isochronous driving procedure is prolonged relatively, or the duration of the image frame with the polarity the same as the polarity of the direct current bias voltage during the isochronous driving procedure is shortened relatively, so as to reduce or even eliminate the direct current bias voltage of the sub pixel, and thus eliminate or alleviate the afterimage of the liquid crystal display panel.

Based on the same principle, other sub pixels of the liquid crystal display panel can also be driven respectively according to the aforesaid method, and the details of which are no longer repeated here.

The present disclosure will be illustrated in detail hereinafter in combination with different embodiments to make the purposes, principles and advantages of the driving method disclosed herein more clear.

Embodiment 1

If the liquid crystal display panel is driven in the conventional isochronous driving method, the common voltage should be reduced to a certain extent in order to avoid an excessive direct current. However, when the common voltage is reduced, a positive direct current bias voltage would exist in some sub pixels after a period of operation. The positive direct current bias voltage needs to be neutralized or reduced in order to eliminate or alleviate the afterimage.

According to the driving method provided by the present embodiment, the durations of the image frames are regulated, so that the duration of the image frame in which the voltage difference between the pixel electrode and the common electrode of the sub pixel is negative (referred to as "negative image frame" hereinafter) is prolonged relatively, or the duration of the image frame in which the voltage difference between the pixel electrode and the common electrode of the sub pixel is positive (referred to as "positive image frame" hereinafter) is shortened relatively, or the duration of the negative image frame is prolonged relatively and at the same time the duration of the positive image frame is shortened relatively. In this manner, the positive direct current bias voltage of the sub pixel can be reduced or even eliminated during the operation of the liquid crystal display panel, and thus the afterimage of the liquid crystal display panel can be alleviated.

Figure 5:
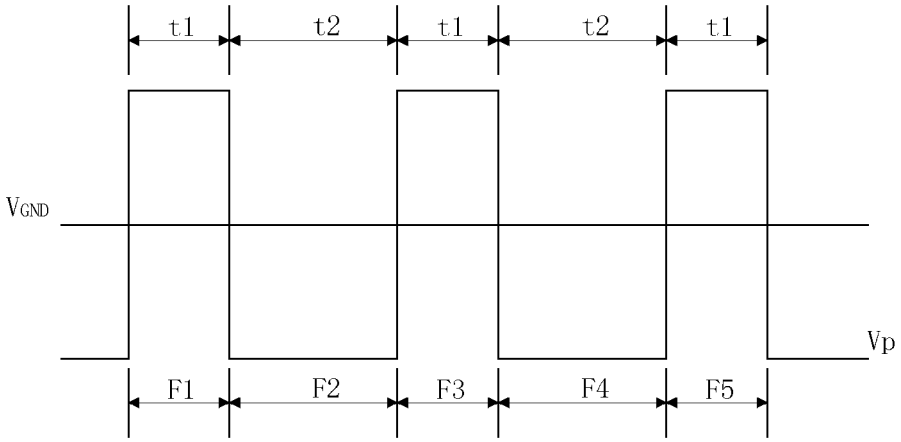
FIG. 5 schematically shows a waveform of a voltage difference between a pixel electrode and a common electrode of a first sub pixel according to an embodiment of the present disclosure.

FIG. 5 schematically shows a waveform of the voltage difference $V_p$ between the pixel electrode and the common electrode of the first sub pixel when the liquid crystal display panel is driven by the method provided by the present embodiment.

According to the present embodiment, if the liquid crystal display panel is driven by the conventional isochronous driving method, the positive direct current bias voltage would exist in the sub pixel after a certain period of operation. It can be seen from FIG. 5 that, according to the method provided by the present embodiment, in a first image frame (i.e., a frame F1), a first voltage difference can be formed between the pixel electrode and the common electrode of the first sub pixel through applying different voltages to the pixel electrode and the common electrode of the first sub pixel. The first voltage difference is positive, i.e., the first image frame is a positive image frame, and the duration thereof is t1.

In a second image frame (i.e., a frame F2), a second voltage difference can be formed between the pixel electrode and the common electrode of the first sub pixel through applying different voltages to the pixel electrode and the common electrode of the first sub pixel. The second voltage difference is negative, i.e., the second image frame is a negative image frame, and the duration thereof is t2.

Similarly, in a third image frame (i.e., a frame F3), a positive voltage difference can be formed between the pixel electrode and the common electrode of the first sub pixel. That is, the third image frame is a positive image frame, and the duration thereof is t1. In a fourth image frame (i.e., a frame F4), a negative voltage difference can be formed between the pixel electrode and the common electrode of the first sub pixel.

That is, the fourth image frame is a negative image frame, and the duration thereof is t2. The positive voltage difference and the negative voltage difference can be formed alternately between the pixel electrode and the common electrode of the first sub pixel, i.e., the positive image frame and the negative image frame are presented by the first sub pixel alternately. In this manner, a sum of the duration t1 of the first image frame and the duration t2 of the second image frame constitutes a first driving cycle, and the voltage difference between the pixel electrode and the common electrode of the first sub pixel changes between the first voltage difference and the second voltage difference cyclically.

In order to reduce or even eliminate the positive direct current bias voltage in the sub pixel during the isochronous driving procedure, according to the present embodiment, the duration of the negative image frame should be larger than the duration of the positive image frame, i.e., t2 is larger than t1. Therefore, when the liquid crystal display panel is driven by the method provided by the present embodiment, the aforesaid positive direct current bias voltage can be reduced or even eliminated when the panel is operated for a long time since the duration of the negative image frame is larger than the duration of the positive image frame during each driving cycle, and thus the afterimage of the liquid crystal display panel can be alleviated or even eliminated.

It should be noted that, according to the present disclosure, the case that a still image is presented on the liquid crystal display panel for a long time is only used for illustrating the principle of the present disclosure more clearly, which does not mean that the driving method provided by the present disclosure is only applicable for the displaying of the still image. According to other embodiments of the present disclosure, dynamic images can also be presented on the liquid crystal display panel. In this case, an absolute value of the voltage difference between the pixel electrode and the common electrode of each sub pixel in one image frame can be different from that in other image frames, and the present disclosure is not limited by this.

At the same time, it should also be noted that, according to other embodiments of the present disclosure, the duration of one positive image frame is not necessarily equal to the durations of other positive image frames, and the duration of one negative image frame is not necessarily equal to the durations of other negative image frames, as long as it can be guaranteed that the total duration of the positive image frames (i.e., a sum of the durations of all positive image frames during the preset period) is less than the total duration of the negative image frames (i.e., a sum of the durations of all negative image frames during the preset period) during the preset display period. The present disclosure is also not limited by this.

Figure 6:
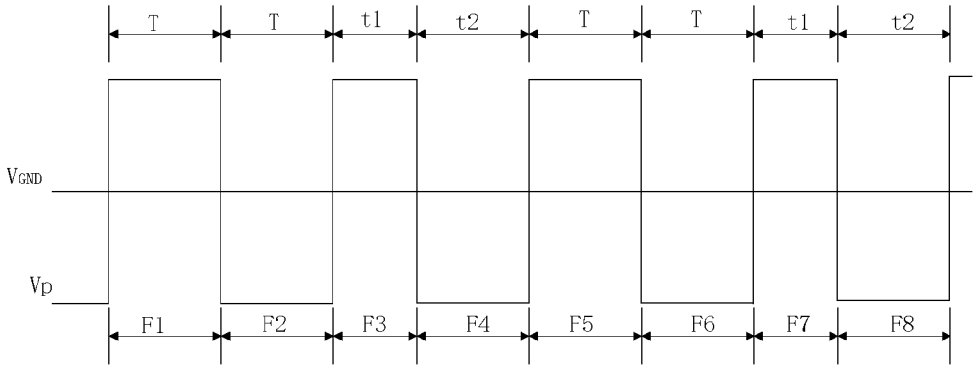
FIG. 6 schematically shows a waveform of a voltage difference between a pixel electrode and a common electrode of a first sub pixel according to an embodiment of the present disclosure.

For example, according to one embodiment of the present disclosure, as shown in FIG. 6, a duration of an image frame F1 is T, a duration of an image frame F2 is also T, and durations of an image frame F3 and an image frame F4 are t1 and t2 respectively, wherein t1 is less than t2. The sub pixel is driven cyclically taking 2T+t1+t2 as a driving cycle.

Thus it can be seen that, in a driving cycle, the frame F1 and the frame F2 are a positive image frame and a negative image frame respectively, and the durations thereof are the same as each other; and the frame F3 and the frame F4 are a positive image frame and a negative image frame respectively, and the duration of the positive image frame (i.e., the frame F3) is less than the duration of the negative image frame (i.e., the frame F4). In this case, the total duration of the positive image frames (i.e., T+t1) is less than the total duration of the negative image frames (i.e., T+t2) during this driving cycle. Therefore, when the sub pixels are driven by the aforesaid signal, the positive direct current bias voltage which would be generated when the sub pixels are driven by the conventional method can be reduced or even eliminated, so that the afterimage of the liquid crystal display panel can be alleviated, and the display effect of the panel can be improved.

It should be noted that, according to different embodiments of the present disclosure, in the waveform as shown in FIG. 6, the duration t1 or the duration t2 can be equal to or unequal to the duration of the image frame F1, and the present disclosure is not limited by this. At the same time, according to different embodiments of the present disclosure, the voltage that is applied to the common electrode (i.e., the common voltage) can be maintained unchanged or changed in different image frames, and the present disclosure is also not limited by this.

Figure 7:
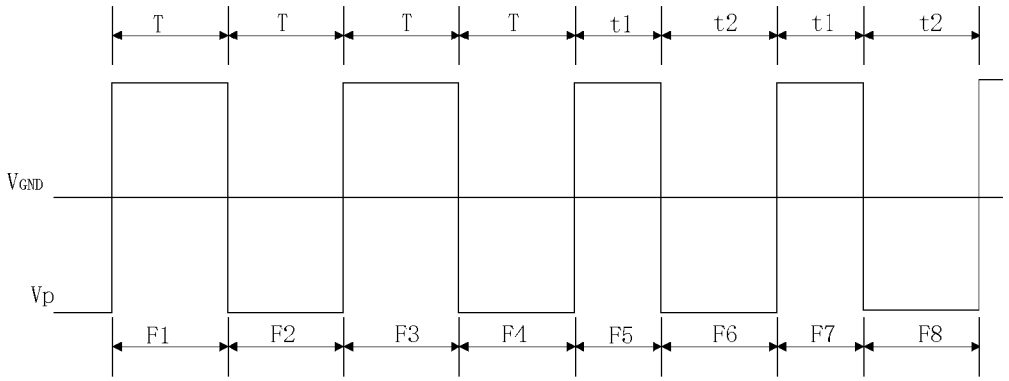
FIG. 7 schematically shows a waveform of a voltage difference between a pixel electrode and a common electrode of a first sub pixel according to an embodiment of the present disclosure.

Similarly, according to other embodiments of the present disclosure, the waveform of the voltage difference between the pixel electrode and the common electrode of the first sub pixel can be the waveform as shown in FIG. 7, and the principle thereof is the same as that of FIG. 6. The details of which are no longer repeated here.

Figure 8:
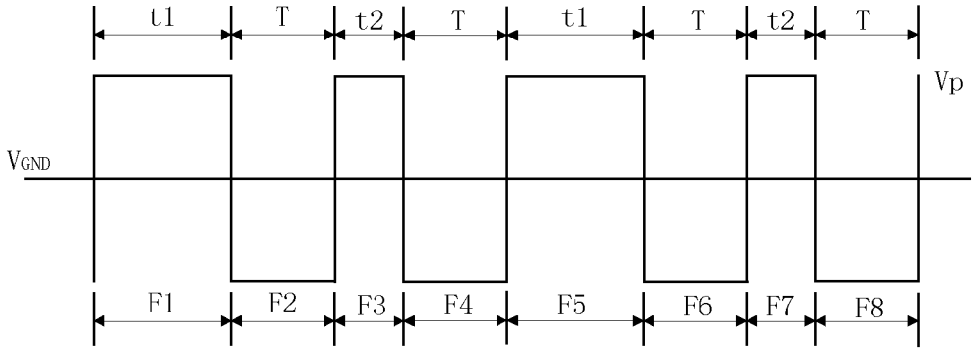
FIG. 8 schematically shows a waveform of a voltage difference between a pixel electrode and a common electrode of a first sub pixel according to an embodiment of the present disclosure.

In addition, according to other embodiments of the present disclosure, the waveform of the voltage difference between the pixel electrode and the common electrode of the first sub pixel in different image frames can be the waveform as shown in FIG. 8. That is, when the duration of the positive image frame is longer in the first image frame and the second image frame, the duration of the negative image frame is longer in the third image frame and the fourth image frame; and when the duration of the negative image frame is longer in the first image frame and the second image frame, the duration of the positive image frame is longer in the third image frame and the fourth image frame. Specifically, in the waveform as shown in FIG. 8, t1 is larger than T, while t2 is less than T. Compared with the conventional isochronous driving method (i.e., the frames each have a same duration), the positive direct current bias voltage of the sub pixel can be reduced or even eliminated when the sub pixel is driven by the signal as shown in FIG. 8 through selecting the values of t1, t2, and T in a reasonable manner, and thus the afterimage of the liquid crystal display panel can be alleviated or even eliminated.

According to the present embodiment, the polarity of the direct current bias voltage (i.e., whether the direct current bias voltage is a positive direct current bias voltage or a negative direct current bias voltage) of the sub pixel can be determined through the following method when the sub pixel is driven in the isochronous driving method. The duration of the positive image frames can be prolonged through regulating the duration of the image frames of the sub pixel. If the afterimage of the liquid crystal display panel is alleviated, it can be determined that the negative direct current bias voltage exists in the sub pixel when the sub pixel is driven in the isochronous driving method; otherwise, it can be determined that the positive direct current bias voltage exists in the sub pixel when the sub pixel is driven in the isochronous driving method.

Of course, according to other embodiments of the present disclosure, the polarity of the direct current bias voltage can also be determined in other reasonable methods, and the present disclosure is not limited by this.

For example, according to one embodiment of the present disclosure, when the afterimage occurs on two liquid crystal display panels with the same batch and type, the duration of the image frames of the first panel can be regulated so that the duration of the positive image frames is prolonged, and the duration of the image frames of the second panel can be regulated so that the duration of the negative image frames is prolonged. Then, it is determined that the afterimage on which panel becomes more serious. If the afterimage on the first panel becomes more serious, it can be determined that the positive direct current bias voltage exists in the liquid crystal display panels of this batch and type. If the afterimage on the second panel becomes more serious, it can be determined that the negative direct current bias voltage exists in the liquid crystal display panels of this batch and type.

Embodiment 2

If the liquid crystal display panel is driven in the conventional isochronous driving method, the common voltage should be reduced to a certain extent in order to avoid an excessive direct current. However, when the common voltage is reduced, a negative direct current bias voltage would exist in some sub pixels after a period of operation.

The negative direct current bias voltage needs to be neutralized or reduced in order to eliminate or alleviate the afterimage. According to the driving method provided by the present embodiment, the durations of the image frames are regulated, so that the duration of the image frame in which the voltage difference between the pixel electrode and the common electrode of the sub pixel is positive (referred to as "positive image frame" hereinafter) is prolonged relatively, or the duration of the image frame in which the voltage difference between the pixel electrode and the common electrode of the sub pixel is negative (referred to as "negative image frame" hereinafter) is shortened relatively, or the duration of the positive image frame is prolonged relatively and at the same time the duration of the negative image frame is shortened relatively. In this manner, the negative direct current bias voltage of the sub pixel can be reduced or even eliminated during the working process of the liquid crystal display panel, and thus the afterimage of the liquid crystal display panel can be alleviated.

Figure 9:
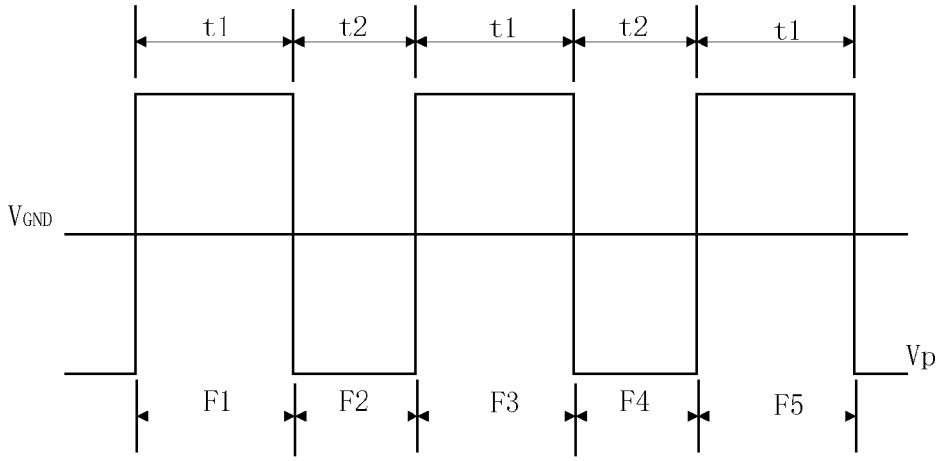
FIG. 9 schematically shows a waveform of a voltage difference between a pixel electrode and a common electrode of a first sub pixel according to an embodiment of the present disclosure.
Figure 10:
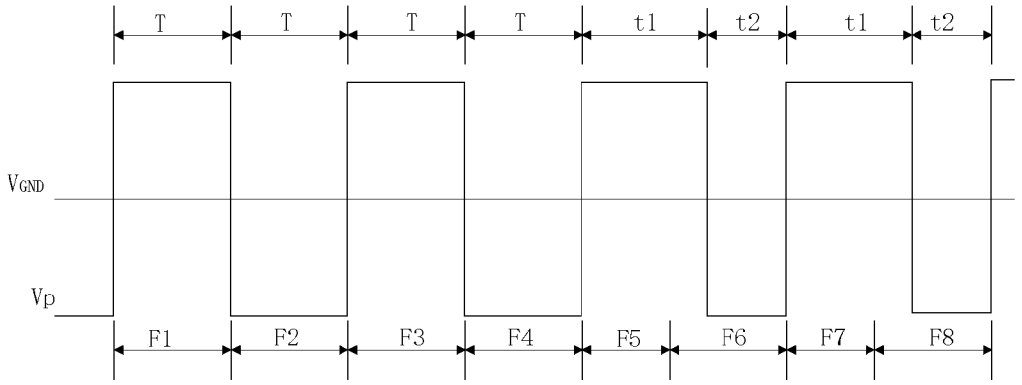
FIG. 10 schematically shows a waveform of a voltage difference between a pixel electrode and a common electrode of a first sub pixel according to an embodiment of the present disclosure.
Figure 11:
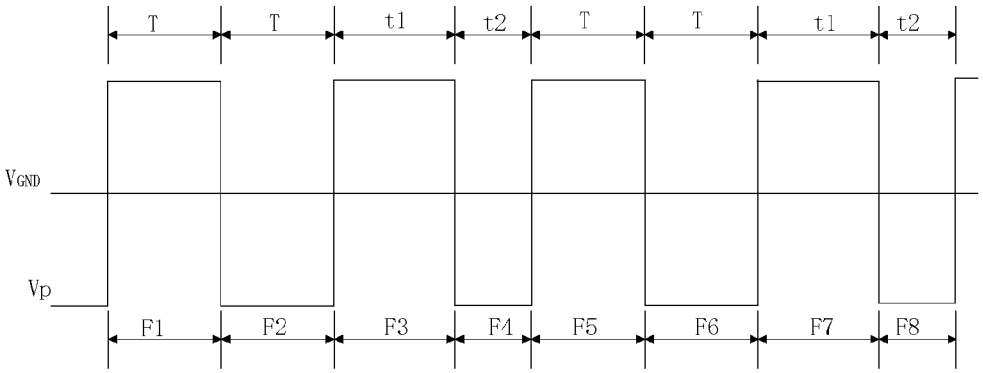
FIG. 11 schematically shows a waveform of a voltage difference between a pixel electrode and a common electrode of a first sub pixel according to an embodiment of the present disclosure.

Specifically, with respect to the sub pixels in which the negative direct current bias voltage would be generated when the sub pixels are driven by the driving method in the prior art (i.e., the isochronous driving method), the waveform of the voltage difference between the pixel electrode and the common electrode in different image frames can be the waveform as shown in FIG. 9 to FIG. 11. The principle thereof is the same as that of embodiment 1, and the details of which are no longer repeated here.

Figure 12:
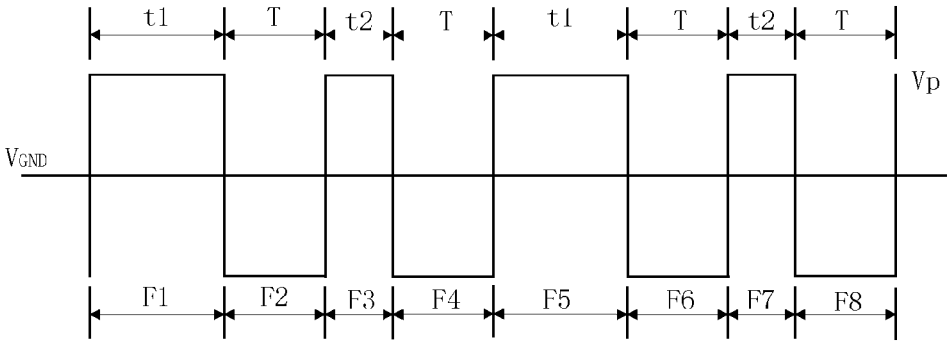
FIG. 12 schematically shows a waveform of a voltage difference between a pixel electrode and a common electrode of a first sub pixel according to an embodiment of the present disclosure.

In addition, according to other embodiments of the present disclosure, the waveform of the voltage difference between the pixel electrode and the common electrode of the first sub pixel in different image frames can be the waveform as shown in FIG. 12. In the waveform as shown in FIG. 12, t1 is larger than T, while t2 is less than T. Compared with the isochronous driving method in the prior art, the negative direct current bias voltage of the sub pixel can be reduced or even eliminated when the sub pixel is driven by the signal as shown in FIG. 12 through selecting the values of t1, t2, and T in a reasonable manner, and thus the afterimage of the liquid crystal display panel can be alleviated or even eliminated.

Embodiment 3

According to the present embodiment, based on the method provided by embodiment 1 or embodiment 2, and with the cooperation of two adjacent data lines, the polarity of the direct current bias voltage of one data line can be arranged opposite to the polarity of the direct current bias voltage of another data line of the two adjacent data lines. In this manner, a voltage difference would exist between the two data lines, and the impurities in the panel can be effectively adsorbed by the voltage difference. Therefore, the extent that the impurities accumulate on the two sides of the liquid crystal display panel can be reduced, and the afterimage thereof can be alleviated.

Specifically, according to the present embodiment, with respect to a first sub pixel and a second sub pixel that are arranged on adjacent data lines respectively, a polarity of a voltage difference of a pixel electrode and a common electrode of the first sub pixel can be arranged to be opposite to that of the second sub pixel during a same image frame through applying different voltages to the pixel electrode and the common electrode of the first sub pixel and the pixel electrode and the common electrode of the second sub pixel respectively. In this case, when a positive direct current exists in the first sub pixel, a negative direct current would exist in the second sub pixel, and thus a voltage difference would be generated between the two sub pixels. Therefore, the extent that the impurities accumulate on the two sides of the liquid crystal display panel can be reduced, and the afterimage thereof can be alleviated.

Figure 13:
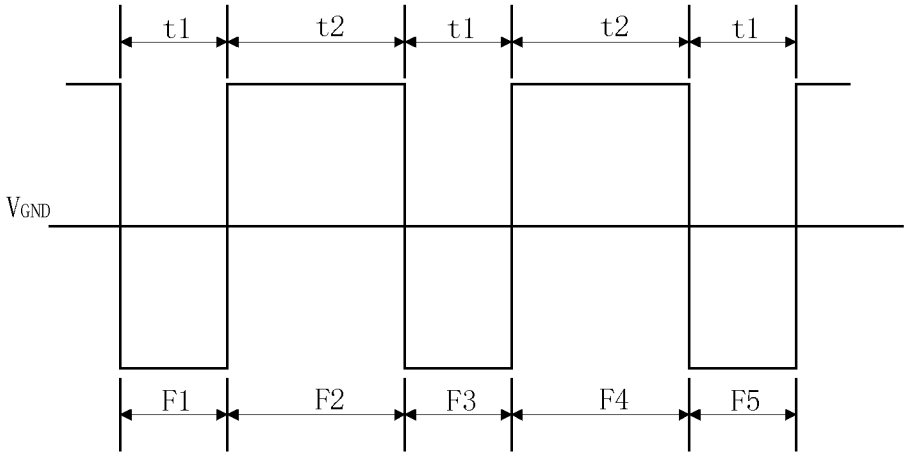
FIG. 13 schematically shows a waveform of a voltage difference between a pixel electrode and a common electrode of a second sub pixel according to an embodiment of the present disclosure.

For example, the waveform of the voltage difference between the pixel electrode and the common electrode of the first sub pixel in different image frames is shown in FIG. 5, and the waveform of the voltage difference as shown in FIG. 13 can be formed between the pixel electrode and the common electrode of the second sub pixel through applying different voltages to the pixel electrode and the common electrode of the second sub pixel. It can be seen from FIG. 5 and FIG. 13 that, the two waveforms are synchronous and have opposite polarities. In this case, the direct current bias voltages with opposite polarities can be formed in the first sub pixel and the second sub pixel. Therefore, the extent that the impurities accumulate on the two sides of the liquid crystal display panel can be reduced, and the afterimage thereof can be alleviated.

It can be seen from the above description that, according to the method for driving the liquid crystal display panel provided by the present disclosure, the duration of the image frame with the polarity the same as the polarity of the direct current bias voltage can be shortened relatively and the duration of the image frame with the polarity opposite to the polarity of the direct current bias voltage can be prolonged relatively through regulating the durations of the image frames. In this case, the direct current bias voltage which would otherwise exist in the isochronous driving procedure can be reduced or even eliminated, so that the afterimage of the liquid crystal display panel can be alleviated, and the display effect thereof can be improved.

Figure 14:
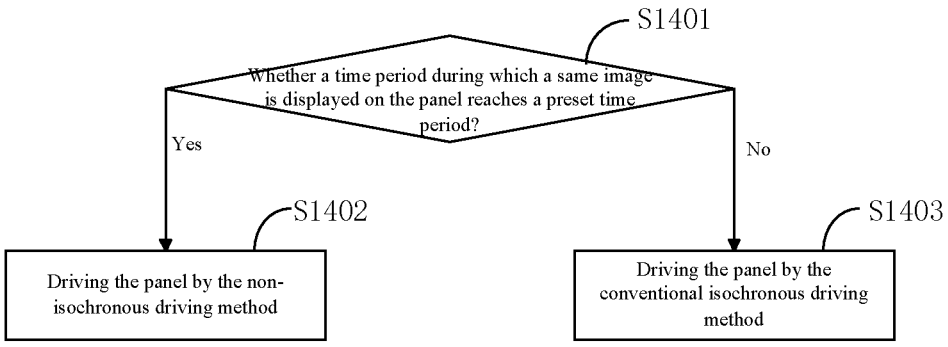
FIG. 14 is a flow chart of a method for driving a liquid crystal display panel according to an embodiment of the present disclosure.

Moreover, the present disclosure further provides a method for driving the liquid crystal display panel. FIG. 14 is a flow chart of the method according to the present embodiment.

As shown in FIG. 14, according to the present embodiment, in step S1401, whether a time period during which a same image is displayed on the liquid crystal display panel reaches a preset time period is determined. If a determination result of step S1401 is positive, step S1402 is performed, i.e., the liquid crystal display panel is driven by the aforesaid non-isochronous driving method so as to avoid the afterimage since the same image is presented on the liquid crystal display panel for a long time. If the determination result of step S1401 is negative, step S1403 is performed, i.e., the liquid crystal display panel is driven by the isochronous driving method in the prior art.

The time period during which the same image is displayed on the liquid crystal display panel does not reach the preset time period means that at this time, dynamic images are displayed on the liquid crystal display panel or a still image is displayed on the liquid crystal display panel for a relatively short time. Under such circumstances, the probability that the afterimage occurs on the liquid crystal display panel is small, and thus the liquid crystal display panel can be driven in the isochronous driving method in order to simplify the driving procedure thereof. In this case, the durations of the image frames do not need to be regulated, so that the data processing amount thereof can be reduced and the driving and display efficiency can be improved.

It could be understood that, the embodiments disclosed herein are not limited by the specific structures, treatment steps or materials disclosed herein, but incorporate the equivalent substitutes of these features which are comprehensible to those skilled in the art. It could be also understood that, the terms used herein are used for describing the specific embodiments, not for limiting them.

The phrases "one embodiment" or "embodiments" referred to herein mean that the descriptions of specific features, structures and characteristics in combination with the embodiments are included in at least one embodiment of the present disclosure. Therefore, the phrases "one embodiment" or "embodiments" appeared in different parts of the whole description do not necessarily refer to the same embodiment.

For the purpose of convenience, a plurality of items and/or component units used herein can be listed in a common list. However, the list shall be understood in a way that each element thereof represents an only and unique member. Therefore, when there is no other explanation, none of members of the list can be understood as an actual equivalent of other members in the same list only based on the fact that they appear in the same list. In addition, the embodiments and examples of the present disclosure can be explained with reference to the substitutes of each of the components. It could be understood that, the embodiments, examples and substitutes herein shall not be interpreted as the equivalents of one another, but shall be considered as separate and independent representatives of the present disclosure.

The embodiments are described hereinabove to interpret the principles of the present disclosure in one application or a plurality of applications. However, a person skilled in the art, without departing from the principles and thoughts of the present disclosure, can make various modifications to the forms, usages and details of the embodiments of the present disclosure without any creative work. Therefore, the protection scope of the present disclosure shall be determined by the claims.

The invention claimed is:

1. A method for driving a liquid crystal display panel, the liquid crystal display panel comprising a plurality of sub pixels, the method comprising:

presenting, in a non-isochronous driving step, images to be displayed on the liquid crystal display panel frame by frame through regulating a gray-scale of each sub pixel of the liquid crystal display panel, wherein durations of image frames are not all equal to one another so as to reduce a direct current bias voltage of the sub pixel and thus alleviate an afterimage of the liquid crystal display panel;

wherein the non-isochronous driving step further comprises:

regulating, during a first display period, a duration percentage of a positive image frame and a duration percentage of a negative image frame according to a polarity of the direct current bias voltage of the sub pixel during an isochronous driving procedure, wherein when the direct current bias voltage has a positive polarity, a duration percentage of the negative image frame is regulated to be larger than a duration percentage of the positive image frame during the first display period so as to reduce a positive direct current bias voltage; and wherein when the direct current bias voltage has a negative polarity, the duration percentage of the positive image frame is regulated to be larger than the duration percentage of the negative image frame during the first display period so as to reduce a negative direct current bias voltage;

wherein the first display period comprises a first image frame, a second image frame, a third image frame and a fourth image frame, a duration of the first image frame is unequal to that of the second image frame, and a duration of the third image frame is unequal to that of the fourth image frame;

wherein when a duration of the positive image frame is longer in the first image frame and the second image frame, a duration of the negative image frame is regulated to be longer in the third image frame and the fourth image frame; and wherein when a duration of the negative image frame is longer in the first image frame and the second image frame, a duration of the positive image frame is regulated to be longer in the third image frame and the fourth image frame.

2. The method according to claim 1, further comprising:

applying, during the first image frame, different voltages to a pixel electrode and a common electrode of a first sub pixel respectively, so as to form a first voltage difference between the pixel electrode and the common electrode of the sub pixel; and applying, during the second image frame, different voltages to the pixel electrode and the common electrode of the first sub pixel respectively, so as to form a second voltage difference between the pixel electrode and the common electrode of the sub pixel, wherein a polarity of the first voltage difference is opposite to that of the second voltage difference, and/or an amplitude of the first voltage difference is equal to that of the second voltage difference.

3. The method according to claim 1, wherein a signal of the sub pixel of the liquid crystal display panel changes cyclically taking the first display period as a cycle.

4. The method according to claim 1, wherein with respect to a first sub pixel and a second sub pixel that are arranged on adjacent data lines respectively, a polarity of a voltage difference of a pixel electrode and a common electrode of the first sub pixel is opposite to that of the second sub pixel during a same image frame.

5. The method according to claim 1, further comprising:

determining whether a time period during which a same image is displayed on the liquid crystal display panel reaches a preset time period, if yes, executing the non-isochronous driving step; and if no, executing an isochronous driving step so as to drive the liquid crystal display panel in an isochronous driving method.

* * * * *